United States Patent [19]

Agiman

[11] 4,361,074

[45] Nov. 30, 1982

[54] HYDROMECHANICAL AUTOMATIC REVERSING DEVICE FOR LINEAR HYDRAULIC RAMS

[76] Inventor: Jacques Agiman, 58 bis, bd Victor Hugo, 92200 Neuilly sur Seine, France

[21] Appl. No.: 138,426

[22] Filed: Apr. 8, 1980

[30] Foreign Application Priority Data

Apr. 9, 1979 [FR] France ..... 79 08891

[51] Int. Cl.[3] ..... F01B 7/18; F01L 31/00

[52] U.S. Cl. ..... 91/279; 91/321

[58] Field of Search ..... 91/277, 279, 321

[56] References Cited

U.S. PATENT DOCUMENTS

| | | | |
|---|---|---|---|
| 154,683 | 9/1874 | Krauss | 91/279 |
| 936,550 | 10/1909 | Mauss | 91/321 |
| 1,796,968 | 3/1931 | Smoot | 91/384 |
| 2,169,470 | 8/1939 | Miller et al. | 91/279 |
| 2,406,747 | 9/1946 | Davis | 91/321 |

FOREIGN PATENT DOCUMENTS

| | | | |
|---|---|---|---|
| 311254 | 2/1916 | Fed. Rep. of Germany | 91/321 |

*Primary Examiner*—Paul E. Maslousky

*Attorney, Agent, or Firm*—Wenderoth, Lind & Ponack

[57] ABSTRACT

This hydromechanical automatic reversing device for linear hydraulic rams operates by inertia and comprises a support block mounted to the ram body, a pendular arm pivoted at one end to the spool of the reversing valve associated with the ram, and, at the opposite end, to an eccentric pin trunnioned in the support block. A shaft rigid with and parallel to the ram piston rod is provided with a pair of adjustable stops adapted to engage by turns the eccentric pin of the pendular arm for shifting the spool of the reversing valve, for reversing the direction of movement of the ram.

12 Claims, 2 Drawing Figures

HYDROMECHANICAL AUTOMATIC REVERSING DEVICE FOR LINEAR HYDRAULIC RAMS

BACKGROUND OF THE INVENTION

1. Field of the Invention

This invention relates in general to hydromechanical automatic reversing devices and has specific reference to an improved device of this type intended more particularly for an easy adaptation thereof to linear hydraulic rams, jacks or like actuators and cylinders, and for controlling a continuous reciprocating motion of the piston of the device while permitting the adjustment thereof at both ends of its stroke, this apparatus combining an outstanding efficiency with a high degree of precision and fidelity of the reversing positions, a quick reversing of the direction of motion and very high rates of operation.

2. Description of the Prior Art

Among hitherto known devices of this character, designed for reversing the direction of movement of the movable member of hydraulic cylinders, rams, jacks and the like, the following may be cited:

(a) hydrochemical systems or purely mechanical mmeans, such as lugs or cams, fixed to the cylinder or to the mechanical device to be driven, which are adapted, at the end of the stroke, to release a mechanism, as a rule spring means, capable of moving the spool of the distributor valve of the cylinder, and thus reversing the piston movement. However, these known systems are objectionable, notably on account of their lack of precision in the cylinder reversing positions, of the relatively long time required for reversing the piston movement, the limited frequency of the reciprocating movements, and a generally fragile, therefore scarcely reliable construction;

(b) hydromechanical devices fixed to the jack and adapted, at the end of the piston stroke, to release a hydraulic monitoring valve controlling the reversing of the main distribution valve of the ram. These devices are objectionable, notably on account of the following drawbacks: lack of precision in the ram reversing positions, relatively long time required for achieving the reversing, limited frequency of the reciprocating movements, and rather complicated and therefore expensive construction;

(c) electromechanical or electrical devices such as switches, proximity detectors, photo-electric cells, etc., actuated at the end of the ram piston stroke, for controlling through an electric switchboard the reversing of a distributor solenoid-valve. This system is characterized by the same inconveniences as those described in paragraph (b) hereinabove;

(d) reversing devices based on the use of special rams actuated by servovalves or servo-controlled rams. In both cases, the hydraulic system and the arm are associated with an electrical control system. These known devices are objectionable mainly for the following reasons: complicated and therefore costly arrangement, difficult and expensive exploitation, due to the specific requirements of the relatively sophisticated apparatus implemented.

SUMMARY OF THE INVENTION

It is the specific object of the present invention to provide a device capable of overcoming the inconveniences of hitherto known and abovementioned solutions brought to the problem set forth, this device being applicable whenever linear hydraulic rams or similar means are required for producing a continuous reciprocating motion within precision-set limits.

It is another object of this invention to provide a device of the type set forth which consistitutes an independent or self-contained unit of particularly simple design and construction, can easily be standardized, and is at the same time sturdy and requires little or no maintenance, and can easily be mounted to the exterior of a ram body of current design.

Therefore, this invention provides an automatic hydromechanical reversing device for linear hydraulic rams or similar actuators, characterized in that it comprises essentially a support block mounted to the ram body, a pendular arm pivoted at one end to the spool of the reversing valve or distributor associated with the ram, and, at its other end, on an eccentric pin trunnioned in the support block, a rod rigid with and parallel to the piston rod of the ram and provided with a pair of adjustable stop members adapted to engage by turns the eccentric pin of the pendular arm for shifting the spool of the reversing valve, and thus reverse the direction of movement of the ram.

According to another feature characterizing this invention, the spool of the reversing valve is slidably fitted in a distribution sleeve having three series of ports connected to the return circuit leading to the hydraulic fluid reservoir, a second series of ports connected to the bottom end of the ram cylinder, and a third series of ports connected to the supply circuit.

According to this invention, the ram operates in the differential mode, and its annular chamber is constantly exposed to the supply pressure. Also, its bottom chamber is adapted to communicate either with the supply circuit or with the fluid reservoir, according to the postion in which the spool is set in the distributor sleeve, and the intermediate position of this spool in the distribution sleeve corresponds to a case in which the ram is brought to a standstill.

Other features and advantages of this invention will appear as the following description proceeds, with reference to the attached drawings illustrating diagrammatically a typical embodiment of the invention given by way of exammple, not of limitation.

DESCRIPTION OF THE PREFERRED EMBODIMENT

Figure 1:
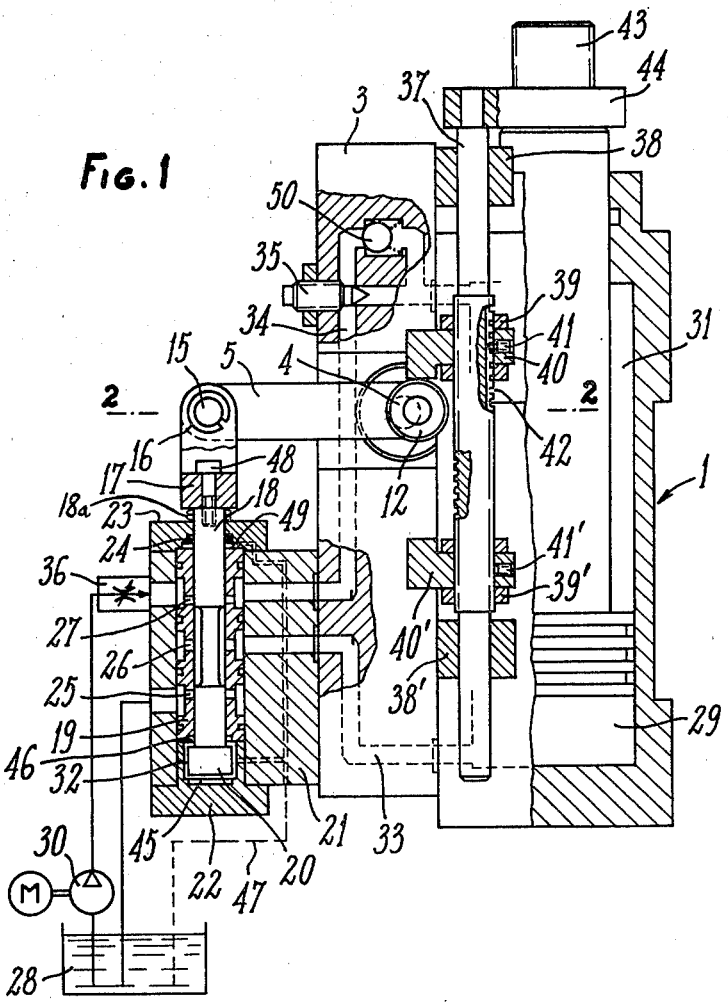
FIG. 1 is an axial vertical section, with parts broken away, showing a hydraulic ram supplied with fluid in the differential fashion, and provided with reversing device according to this invention; and, FIG. 2 is a fragmentary section, taken along the line 2—2 of FIG. 1.
Figure 2:
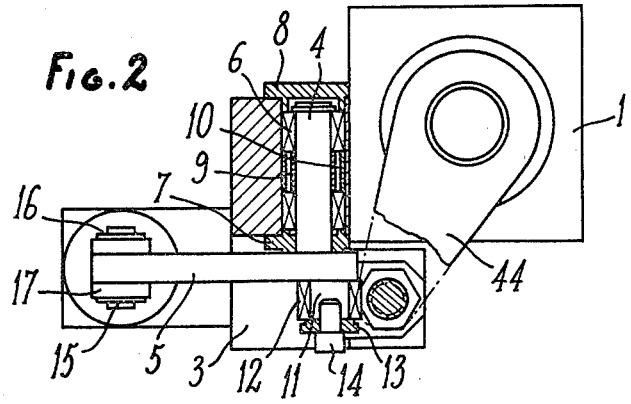

In this specific and exemplary embodiment, the hydraulic ram 1, of standard design and construction, has affixed thereto through conventional fastening means, for example screws or bolts, a reversing device constructed according to the teachings of this invention and to be described hereinafter.

This reversing device comprises a support block 3 having pivotally mounted therein a pivot shaft 4 of a pendular arm 5 which is fitted in needle bearings 6 retained in the axial direction by end flanges 7, 8 and distance-pieces or spacers 9 and 10.

The pivot shaft 4 of pendular arm 5 has a slightly eccentric outer extension 11 supporting a roller 12 by means of needle bearings, retained in position by a washer 13 and a screw or bolt 14.

The pendular arm 56 has its other end pivoted, by means of a pin 154 and circlips 16, to a bifurcated member 17 rigidly assembled to a spool 18 of a reversing valve by a screw or bolt 48, or any other equivalent means.

The angular movements of pendular arm 5 about its axis of rotation, i.e. the pivot shaft 4, provide, by reason of the arm dimensions, a very considerable (for example about twenty to one) step-up ratio or lever advantage between the movement of the needle-bearing supported roller 12 and the movement of member 17, or the movement of the spool 18 of the reversing valve, respectively.

According to a specific feature characterizing this invention, this spool 18, provided with a dash-pot or limit stop 20, is movable within the limits of a relatively reduced stroke within a ram distributor sleeve 19, which is secured in a reversing valve body 21 by a bottom wall 22 and a flange 23 provided with a seal 24. The bottom wall 22 and the distributor sleeve 19 are also provided with recesses 45, 46 fitting to the dash-pot 20 and constituting damping chambers operating to absorb shocks, prevent rebounds, and regularize the movements of spool 18.

In certain specific applications, for example those in which the ram operates in a vertical position and performs very slow movements, the addition of spring means 18a may be contemplated for compensating, if necessary, for the weight of the assembly comprising the spool 18, member 17 and pendular arm 5.

The distributor sleeve 19 of the reversing valve is provided with three series of ports 25, 26 and 27, advantageously in the form of elongated holes, with a view to obtain a maximal aperture for a predetermined movement of spool 18. Ports 25 are connected to a return circuit leading to the fluid reservoir 28, ports 26 are connected to a bottom end 29 of the cylinder of ram 1, and ports 27 are connected to a pressure circuit from a supply pump 30.

The ram 1 operates in the differential mode, and has annular chamber 31 which is constantly responsive to the pressure prevailing in the supply circuit, and the larger cross-sectional area, on the bottom side 29, is adapted to be connected either to the supply circuit from pump 30 or to the reservoir 28, according to the momentary position of spool 18 in its distributor sleeve 19, The intermediate position of spool 18 in distributor sleeve 19, i.e. with ports 25 and 27 closed, corresponds to the locked or stationary condition of ram 1.

The diameter of the ram piston rod may be so selected that the surface area of the annular chamber and the cross-sectional surface area of the rod itself are substantially equal, that is, with a value corresponding to 0.707 times the ram bore, so that substantially equal speeds can be obtained in both directions of movement.

A front chamber 49 and a rear chamber 32 of the reversing valve are connected to the fluid reservoir 28 via a separate leakage recovery conduit 47, possibly connected directly to the general return circuit of the distributor valve.

Passages 33 and 34 from the valve to the ram 1 are formed (thus avoiding any external piping) directly through the valve body 21 and the support block 3, which are so assembled with each other and with the ram as to constitute a unitary structure.

In the passage 34, an adjustable throttle means 35 is provided for retarding the flow of fluid from annular chamber 31 of ram 1, through ports 27, 26, to the larger cross-sectional area of the bottom side 29, together with a valve 50 securing the flow of the fluid from the pump 30 to the annular chamber 31, via valve ports 27.

Furthermore, the device of this invention comprises an output regulator 36 affixed to the valve body 21, to permit the adjustment at will of the fluid output delivered to the device, which remains constant independently of the efforts and power produced in the ram 1, of the fluid temperature, of the circuit pressure, and other parameters.

Finally, the device comprises a rod 37 parallel to the ram and provided with a pair of guide lands at its ends and also with a square-threaded portion affording both the sliding thereof in bearings 38, 38' and its engagement by matching nuts 39, 39', for a purpose to be explained presently. According to this invention, a pair of adjustable stop members 40, 40', centered by means of their bores on rod 37, and adapted to be moved in the axial direction, but held against rotation about rod 37, are provided. To this end, stud or shouldered screws 41, 41', guided in a groove 42 formed in rod 37, are also provided. The stop members 40, 40' are adjusted and locked in the selected operating positions on rod 37, by means of the pair of nuts 39, 39', respectively, which are locked against each other. The rod 37 is rigidly assembled with a piston rod 43 of ram 1 by means of a coupling strap 44.

Due to its convenient configuration, the device can easily be concealed in a hood or casing (not shown), so as to isolate it from the external atmosphere, thus ensuring an efficient protection of the mechanism, improving the operator's safety, and affording sound insulation with respect to the environment.

The above described device operates as follows:

The apparatus is started or stopped by opening or closing the pressure circuit, by actuating either the regulator 36 or an ON/OFF valve possibly inserted in the circuit.

Since the ram 1 is supplied in the differential mode, when the spool 18 of the reversing valve is moved outwards, the major cross-sectional area 29 and the minor cross-sectional area 31 will be subjected to the pressure produced in the hydraulic circuit.

The piston rod 43 of ram 1 is thus caused to move outwards and carries aong the rod 37 to which it is rigidly coupled via the strap 44, until the stop member 40' engages the roller 12 and moves in turn the pendular arm 5, which, consequently, is rotated bout its pivot shaft 4, thus reversing the ram piston movement.

This reversing movement occurs in two steps:

(a) the pendular arm 5 is moved by means of roller 12 (mounted in needlebearings) with a very strong acceleration, due to the considerable power output produced by the hydraulic ram.

This movement is amplified with a very high step-up ratio (for example 20:1) and transmitted to the spool 18, which is thus caused to retract at a considerably increased speed within the valve, thus closing ports 25 and 27. In this well-defined position, the piston rod 43, rod 37, and consequently stop members 40, 40' of the ram, are stopped;

(b) however, the pendular arm 5 and spool 18 continue their movements, the drive being provided by the kinetic energy stored during the first step (a), and these elements are brought to a standstill either as a consequence of frictional forces, or when the dash-pot 20 penetrates into the damping chamber 45 and is retarded thereby.

Ports 25 are now open, thus connecting the bottom chamber 29 to the fluid reservoir 28, while the annular chamber 31 is still connected to the pressure circuit. Rod 37 is moved inwardly of the ram.

The reversing cycle is started again in the opposite direction when the stop member 40 engages roller 12 and moves the valve spool 18 outwards.

It will be seen that the operation of the device of this invention, as far as its efficiency is concerned, may be improved considerably by the following factors:

selecting a hydraulic ram capable of producing relatively high force, and therefore of operating under a higher pressure;

rigidity and sturdiness of the component elements of the mechanism;

selecting a high step-up ratio for the pendular arm 5, the rotation of which is permitted by the provision of the needle bearings, so that frictional contacts are reduced considerably;

very reduced stroke necessary for closing the ports, by means of spool 18, in distributor sleeve 19 (i.e. a very reduced range of positions in which the valve ports are closed). Likewise, the valve port opening movement is minimized, since these ports consist of elongated holes.

Among the advantageous features characterizing the device of this invention, and in comparison with the prior art arrangements broadly set forth in the preamble of this specification, the following may be cited, inter alia:

simplicity of design and construction of the apparatus, leading to a reduced cost;

simplicity of the adaptation and starting of the ram plus the reversing device of the instant invention to the assembly utilizing this device, this adaptation consisting simply in coupling the fastening means and connecting the supply inlets to the fluid-pressure conduits or pipings and the outlets to the return lines of a hydraulic central system;

the assembled device, adjusted and tested at the manufacturer's shop, is protected from external agents and nuisances by its sturdy construction and can easily be enclosed in a casing or housing, so that its safety of operation is extremely reliable;

all maintenance problems, which, up to now, proved to be rather difficult to solve, notably in complex hydraulic and servo systems using electronic apparatus, are positively avoided for the user;

this ram plus reversing device assembly affords a perfect control of the linear reciprocating movements, with a really unusual degree of precision in the end-stroke reversing positions;

due to the fact that the reversing time is extremely short and practically instantaneous, and since the ram speed and stroke are adjustable, it is an easy matter for the user to obtain movements having very different speeds, strokes and rates or frequencies, and a particularly advantgeous application consists in obtaining short-stroke movements at very high rates, for, in this case, the device of the present invention will nevertheless operate with an outstanding high degree of precision and an exceptional regularity in the cycle;

also in those cases where a mass of considerable weight is attached to the ram piston rod, very interesting applications may be contemplated, due to the possibility of constructing fast-operating presses, power-hammers, crushing mills, and the like, of definitely simplified construction in comparison with hitherto known machines of this type;

the original conception of the reversing device of this invention does not imply any limitation, as to the size and stroke of the ram piston, this also applying to the performances contemplated (speed, rate, effort) which are obtainable without any difficulty in the various possible applications. As a result, and for the reasons set forth hereinabove, considerable savings, both in capital investment and floor space, can be made by eliminating costly reversing systems comprising complicated hydraulic, electronic, mechanical apparatus.

The device according to the present invention is applicable in all cases wherein a continuous linear reciprocating motion is required in conjunction with the generation of considerable efforts.

Particularly advantageous applications may be contemplated in the fields of machine-tools, transfer machines and special machines, whenever specific motions and efforts with accurately determined speeds, strokes and reversing positions are required, and also in systems involving the generation of alternating movements or efforts at relatively high rates or frequencies, such as vibratory machines and apparatus, machines and benches for executing fatigue tests, simulators, fast-action presses, power-hammers, crushing mills, and the like.

Of course, this invention should not be construed as being strictly limited by the specific and preferred embodiment shown and described herein, since many modifications may be made thereto without departing from the basic principles of the invention, as set forth in the appended claims.

What I claim is:

1. A hydromechanical apparatus comprising:

a hydraulic machine including a ram body and a ram piston movable in opposite linear directions in said ram body;

a support block mounted on said ram body;

ram distributor valve means, including a spool movable in opposite linear directions, operatively connected to said hydraulic machine for, upon movement of said spool in opposite linear directions, reversing the direction of movement of said ram piston within said ram body;

a pendular arm having first and second ends, said first end being pivotally connected to said spool, said second end supporting a pivot shaft journalled in said support block and an extension positioned eccentric to said pivot shaft;

a rod rigid with and extending parallel to and laterally spaced from said ram piston and movable therewith in opposite linear directions;

a pair of adjustble rigid stop means carried by said rod for, upon movement of said ram piston in opposite linear directions, engaging said extension, thereby rotating said pendular arm in opposite directions about said pivot shaft and causing movement of said spool in opposite linear directions, thus causing said ram distributor valve means to reverse the direction of movement of said ram piston within said ram body;

the dimensions of said pendular arm, between said extension and said pivot shaft and between said pivot shaft and said first end of said pendular arm, being selected such that a relatively short stroke of said ram piston transits a highly stepped-up length and speed of stroke to said spool, thus obtaining a high degree of precision at the motion reversing positions of said ram piston and a high speed reversal of said spool of said ram distributor valve means; and said ram distributor valve means including damping chamber means for, in cooperation with said spool, damping movement of said spool and absorbing shocks and preventing rebounds thereof.

2. An apparatus as claimed in claim 1, wherein said pivot shaft is journalled in bearings in said support block, and said extension has journalled thereto by means of bearings a roller adapted to be abutted by said pair of adjustable stop means.

3. An apparatus as claimed in claim 1, wherein said ram distributor valve means further includes a distribution sleeve within which said spool moves in opposite directions, said damping chamber means comprise recesses formed in said distribution sleeve, and an end of said spool has an enlarged portion adapted to be received with a tight fit and in a throttling manner within said recesses.

4. An apparatus as claimed in claim 3, further comprising a fluid circuit including a fluid reservoir, a return circuit portion returning to said reservoir and a supply circuit portion for supplying fluid from said reservoir, and said distributor sleeve has therein first ports connected to said return circuit portion, second ports connected to an end chamber in said ram body at a first end of said ram piston, and third ports connected to said supply circuit portion.

5. An apparatus as claimed in claim 4, wherein said ram body has therein an annular chamber spaced from said end chamber, said ram distributor valve means includes means for connecting permanently said supply circuit portion to said annular chamber, said spool is movable in said opposite linear directions within said distributor sleeve between opposite end positions and an intermediate position, said ram distributor valve means includes means for connecting said end chamber with said supply circuit portion at a first end position of said spool and to said return circuit portion at a second end position of said spool, and said intermediate position of said spool corresponds to a stationary position of said ram piston.

6. An apparatus as claimed in claim 5, wherein said ram piston moves in a bore in said ram body, and further comprising a ram piston rod extending from said ram piston and defining, with said bore, said annular chamber, the diameter of said ram piston rod being approximately 0.707 times the diameter of said bore, the transverse cross-sectional area of said annular chamber being substantially equal to the transverse cross-sectional area of said ram piston rod, and the speed of said ram piston being substantially equal in said opposite linear directions of operation.

7. An apparatus as claimed in claim 5, wherein said ram distributor valve means further includes a valve body supporting said distributor sleeve, said valve body, said support block and said ram body are assembled as a unitary structure, said permanently connecting means comprise first passages formed in said unitary structure and connected to said third ports, and said end chamber connecting means comprises second passages formed in said unitary structure and connected to said second ports and recess means formed in said spool for connecting said second and third ports when said spool is in said first end position thereof and for connecting said second and first ports when said spool is in said second end position thereof.

8. An apparatus as claimed in claim 4, wherein said first, second and third ports formed in said distributor sleeve are elongated in the direction of movement of said spool.

9. An apparatus as claimed in claim 4, wherein said supply circuit portion of said fluid circuit includes output reglator means for selectively adjusting the fluid supply to the apparatus, said supply remaining constant despite possible variations in force produced by said ram piston, the temperature of the fluid or the pressure of the fluid circuit.

10. An apparatus as claimed in claim 4, wherein ram distributor valve means further includes opposite end chambers, and leakage recovery conduit means extending from said opposite end chambers to said reservoir.

11. An apparatus as claimed in claim 4, wherein the stroke of said spool in said distributor sleeve is short, thereby providing accurately defined positions for reversing movement of said ram piston.

12. An apparatus as claimed in claim 1, wherein said first end of said pendular arm is connected to said spool by means of a bifurcated member, said spool is aligned substantially vertically with said member thereabove, and further comprising spring means for compensating for the weight of said member and said pendular arm.

* * * * *